US007920053B2

(12) United States Patent
Pattok et al.

(10) Patent No.: US 7,920,053 B2
(45) Date of Patent: Apr. 5, 2011

(54) NOTIFICATION SYSTEM AND METHOD THEREOF

(75) Inventors: Greg R. Pattok, Holland, MI (US); Michael B. DeWarrd, Holland, MI (US); Scott R. Edwards, Alto, MI (US); Sue F. Franz, Holland, MI (US); Christopher D. Stirling, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 295 days.

(21) Appl. No.: 12/188,740

(22) Filed: Aug. 8, 2008

(65) Prior Publication Data

US 2010/0033319 A1 Feb. 11, 2010

(51) Int. Cl.
*H05B 39/00* (2006.01)
*H05B 41/00* (2006.01)

(52) U.S. Cl. ..... 340/331; 340/691.1; 340/506

(58) Field of Classification Search ..... 340/331, 340/691.1, 691.8, 332, 539.11, 539.16, 539.17, 340/539.26, 506, 521, 533, 628, 825.36, 340/825.49

See application file for complete search history.

(56) References Cited

U.S. PATENT DOCUMENTS

| | | | |
|---|---|---|---|
| 3,921,034 | A | 11/1975 | Nakamura |
| 4,132,926 | A | 1/1979 | Ohta et al. |
| 4,274,084 | A | 6/1981 | Haus |
| 4,363,031 | A | 12/1982 | Reinowitz |
| 4,499,453 | A | 2/1985 | Right |
| 4,734,680 | A | 3/1988 | Gehman et al. |
| 4,742,328 | A | 5/1988 | Arai et al. |
| 4,951,081 | A | 8/1990 | Hosomizu et al. |
| 4,952,906 | A | 8/1990 | Buyak et al. |
| 5,019,805 | A | 5/1991 | Curl et al. |
| 5,078,039 | A | 1/1992 | Tulk et al. |
| 5,386,209 | A | 1/1995 | Thomas |
| 5,525,962 | A | 6/1996 | Tice |
| 5,559,492 | A | 9/1996 | Stewart et al. |
| 5,587,705 | A | 12/1996 | Morris |
| 5,598,139 | A | 1/1997 | Karim et al. |
| 5,622,427 | A | 4/1997 | Lemons et al. |
| 5,627,515 | A | 5/1997 | Anderson |
| 5,659,287 | A | 8/1997 | Joseph et al. |
| 5,777,551 | A | 7/1998 | Hess |
| 5,850,180 | A | 12/1998 | Hess |
| 5,898,369 | A | 4/1999 | Godwin |
| 5,933,078 | A | 8/1999 | O'Donnell |

(Continued)

OTHER PUBLICATIONS

Communication from the Korean Intellectual Property Office, International Search Report, Mailed on Mar. 9, 2010.

(Continued)

*Primary Examiner* — John A Tweel, Jr.

(74) *Attorney, Agent, or Firm* — Price, Heneveld, Cooper, DeWitt & Litton LLP

(57) ABSTRACT

A notification system and method of visual notification of different types of events by flashing different colors is provided, wherein the notification system includes a master controller and a notification device. The master controller is configured to communicate at least one signal. The notification device includes an enclosure accepting a plurality of conductors providing both signaling and electrical power to the notification device, and at least one strobe drive circuit configured to supply an electrical signal for periodically flashing at least one strobe. The notification device further includes a strobe system configured to flash at least one strobe, such that the strobe system flashes one of at least two different colors, and a control logic configured to determine which color of the at least two different colors to flash at least one strobe based upon the signal received from at least one of the plurality of conductors.

49 Claims, 16 Drawing Sheets

U.S. PATENT DOCUMENTS 6,078,269 A 6/2000 Markwell et al.
6,110,038 A 8/2000 Stern
6,150,774 A 11/2000 Mueller et al.
6,217,196 B1 4/2001 Kosich et al.
6,225,910 B1 5/2001 Kadwell et al.
6,243,001 B1 6/2001 Kodaka
6,297,610 B1 10/2001 Bauer et al.
6,313,744 B1 11/2001 Capowski et al.
6,326,897 B2 12/2001 Kadwell et al.
6,411,201 B1 6/2002 Hur et al.
6,426,697 B1 7/2002 Capowski et al.
6,522,248 B1 2/2003 Andres et al.
RE38,183 E 7/2003 Kosich et al.
6,611,204 B2 8/2003 Schmurr
6,614,347 B2 9/2003 Tanguay
6,624,597 B2 9/2003 Dowling et al.
6,311,021 B1 10/2003 Kosich
6,646,566 B1 11/2003 Tanguay
6,653,942 B2 11/2003 Kadwell et al.
6,680,834 B2 1/2004 Williams
6,693,532 B2 2/2004 Capowski et al.
6,717,376 B2 4/2004 Lys et al.
6,720,881 B1 4/2004 Halliday
6,720,883 B2 4/2004 Kuhr et al.
6,774,584 B2 8/2004 Lys et al.
6,777,891 B2 8/2004 Lys et al.
6,778,082 B2 8/2004 Goodwin
6,788,011 B2 9/2004 Mueller et al.
6,791,453 B1 9/2004 Andres et al.
6,793,375 B2 9/2004 Anderson
6,801,003 B2 10/2004 Schanberger et al.
6,806,659 B1 10/2004 Mueller et al.
6,816,068 B2 11/2004 McCuen et al.
6,833,783 B2 12/2004 Ha et al.
6,839,636 B1 1/2005 Sunshine et al.
6,873,254 B2 3/2005 Andres et al.
6,876,305 B2 4/2005 Kadwell et al.
6,888,322 B2 5/2005 Dowling et al.
6,897,624 B2 5/2005 Lys et al.
6,954,137 B2 10/2005 Stewart et al.
7,005,971 B2 2/2006 Stewart et al.
7,005,994 B2 2/2006 King
7,006,003 B2 2/2006 Zimmerman et al.
7,038,399 B2 5/2006 Lys et al.
7,057,517 B1 6/2006 Convery
7,103,511 B2 9/2006 Petite
7,202,613 B2 4/2007 Morgan et al.
7,227,463 B2 6/2007 Merrell
7,233,781 B2 6/2007 Hunter et al.
7,245,216 B2 7/2007 Burkley et al.
7,258,463 B2 8/2007 Sloan et al.
7,298,252 B1 11/2007 Sutardja et al.
7,336,168 B2 2/2008 Kates
7,339,468 B2 3/2008 Andres et al.
7,342,488 B2 3/2008 Wolfe et al.
7,378,954 B2 5/2008 Wendt
7,382,243 B1 6/2008 Shepher
7,385,517 B2 6/2008 Andres et al.
7,400,439 B2 7/2008 Holman
7,417,540 B2 8/2008 Johnston et al.
7,423,544 B2 9/2008 Cartwright et al.
2002/0075473 A1 6/2002 Davidson et al.
2002/0163438 A1 11/2002 Kuhr et al.
2003/0071735 A1 4/2003 Hanson et al.
2006/0092012 A1 5/2006 Kaiser et al.
2007/0171044 A1 7/2007 Ollis et al.
2007/0182543 A1 8/2007 Luo
2009/0072989 A1 3/2009 Rock et al.

OTHER PUBLICATIONS

Curran et al., "An examination of a prototype LED fire alarm signaling appliance," Fourth International Conference on Solid State Lighting, Proc. of SPIE (2004), vol. 5530, pp. 26-37, Bellingham, WA (12 pages).

Jensen, "Inductive Based Switching Regulator Circuits Provide High Efficiency White LED Drives," National Semiconductor Note 1250, Sep. 2002, 3 pages, found at: www.national.com.

| | Typ | units | Description |
|---|---|---|---|
| T1 | 4 | Sec | Temporal Pattern Length |
| T2 | 1 | Sec | Flash/Sync Rate |
| T3 | 30 | mSec | Mute Pulse |
| T4 | 14 | mSec | Sync Pulse |
| T5 | 40 - 250 | mSec | Color Selections |

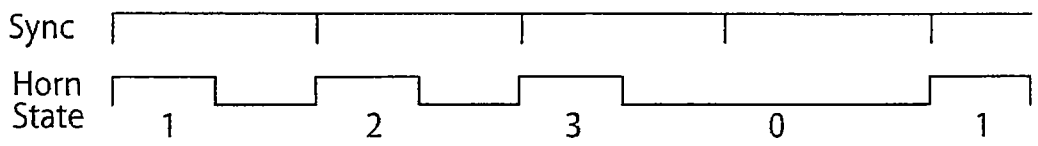

State table of two pulse combinations:

Key:
Sp = Short Pulse; Pulse Low Time < 26ms
Lp = Long Pulse Pulse Low Time >= 26ms
DPm = Double pulse Mute Condition; Two pulses separated by 50ms < T < 120ms
DPt = Double Pulse Temporal Condition; Two pulses separated by (10ms < T <= 50ms) OR (120ms =< T < 250ms)
U = Unknown; Pulse has multiple meanings Single Pulse Protocol

| Last Pulse | This pulse | This State | |
|---|---|---|---|
| Sp | Sp | U | |
| Sp | Lp | 0 | |
| Lp | Sp | 1 | Syncing pattern |
| Lp | Lp | 3 | Muting pattern |

Double Pulse Protocol

| Last Pulse | This pulse | This State | |
|---|---|---|---|
| DPm | Lp | 3 | |
| DPt | Sp | 1 | |
| DPt | Lp | 1 | |
| Lp | DPm | 3 | Muting pattern |
| Lp | DPt | 0 | Syncing pattern |
| Sp | DPt | 0 | Syncing pattern |
| Lp | Lp | U | |
| Sp | Sp | U | |

FIG. 10C

FIG. 10D
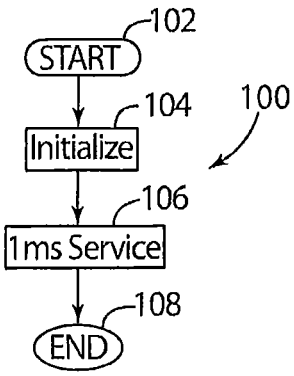
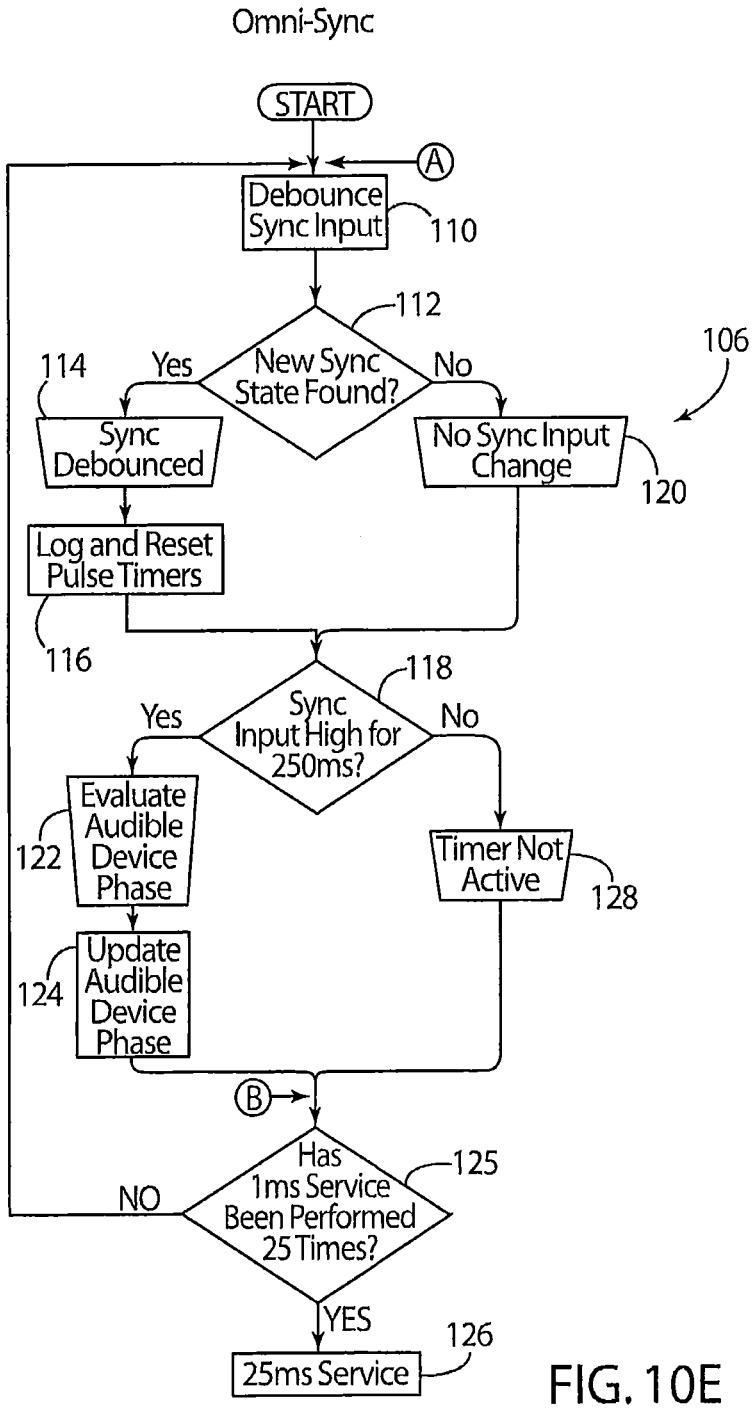
FIG. 10E

NOTIFICATION SYSTEM AND METHOD THEREOF

FIELD OF THE INVENTION

The present invention generally relates to a notification system and method thereof, and more particularly, to a notification system and method for notifying at least one person when an emergency situation is detected.

BACKGROUND OF THE INVENTION

Generally, a notification system notifies a person of an emergency situation that is detected. A notification system that is capable of notifying a person of multiple emergency situations typically contains a plurality of lighting sources that illuminate or emit light at different colors, wherein separate wiring and power supplies are used for each group of lighting sources. By requiring separate wiring and power supplies for each lighting source of a different color, the installation of a notification system can become more expensive and complex. Additionally, due to the increase in emergency situations in which people must be notified (e.g., fire, hazardous weather, terrorist attack, etc.) it is becoming more important for the notification system to include different color lighting sources.

Additionally, once a notification system has been installed in a building structure, the notification devices typically must be made by the same manufacturer as a master controller of the notification system, so that the master controller and the notification device are compatible. Generally, if a notification device is implemented in the notification system that differs from a manufacturer of the master controller, the notification device will not work properly, such that a flashing of the lighting source will not be synchronized with an audible noise emitted by the notification device.

SUMMARY OF THE INVENTION

According to one aspect of the present invention, a notification device is provided that includes an enclosure accepting a plurality of conductors that supply both a signal and electrical power, and at least one strobe drive circuit configured to supply an electrical signal for periodically flashing at least one strobe. The notification device further includes a strobe system in communication with the strobe drive circuit, wherein the strobe system is configured to flash the at least one strobe, such that the strobe system flashes one of at least two different colors, and a controller in communication with at least one of the plurality of conductors, wherein the controller is configured to determine which color of the at least two different colors to flash the at least one strobe based upon the signal received from at least one of the plurality of conductors.

According to another aspect of the present invention, a method of visual notification of different types of events by flashing different colors is provided that includes the steps of receiving a periodic signal in each of a plurality of notification devices, and determining a color and a flash rate in at least one of the plurality of notification devices based upon data contained in the periodic signal. The method further includes the step of flashing at least one strobe at the determined color and flash rate in at least one of the plurality of notification devices.

According to yet another aspect of the present invention, a notification system is provided that includes a master controller, a smoke detector in communication with the master controller, a notification device in communication with the master controller, and an Ethernet connection. The notification device includes at least one strobe drive circuit configured to supply an electrical signal for periodically flashing at least one strobe. The Ethernet connection connects the master controller and the smoke detector device, wherein an electrical power is supplied to the smoke detector device, and a data signal is communicated between the master controller and the smoke detector device over the Ethernet connection.

According to another aspect of the present invention, a notification system is provided that includes a notification device and vibration notification device. The notification device is configured to flash at least one strobe in one of at least two different colors based upon a received electrical signal during a time period. The vibration notification device is remote from the notification device, and is configured to vibrate based upon a received signal, such that the vibration notification device vibrates during the time period the notification device flashes the at least one strobe.

According to yet another aspect of the present invention, a notification device is provided that includes at least one strobe drive circuit configured to provide an electrical signal for periodically flashing at least one strobe based upon a received signal, and a strobe system in communication with the strobe drive circuit, wherein the strobe system is configured to flash at least one strobe in one of at least two different colors. The notification device further includes an audible device configured to emit an audible noise, wherein the flashing of the at least one strobe and the emitting of the audible noise are substantially synchronized when the received signal is a protocol that is different than an operating protocol of at least one notification device.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which:

FIG. 10C is a diagram illustrating the recognition of different states of the exemplary timing algorithms for the plurality of protocols illustrated in FIGS. 10A and 10B, in accordance with one embodiment of the present invention;

FIGS. 10D-10G illustrate a method of synchronizing a flashing of a strobe and an emittance of an audible noise from an audible noise device, in accordance with one embodiment of the present invention.

DETAILED DESCRIPTION OF PREFERRED EMBODIMENTS

Figure 1:
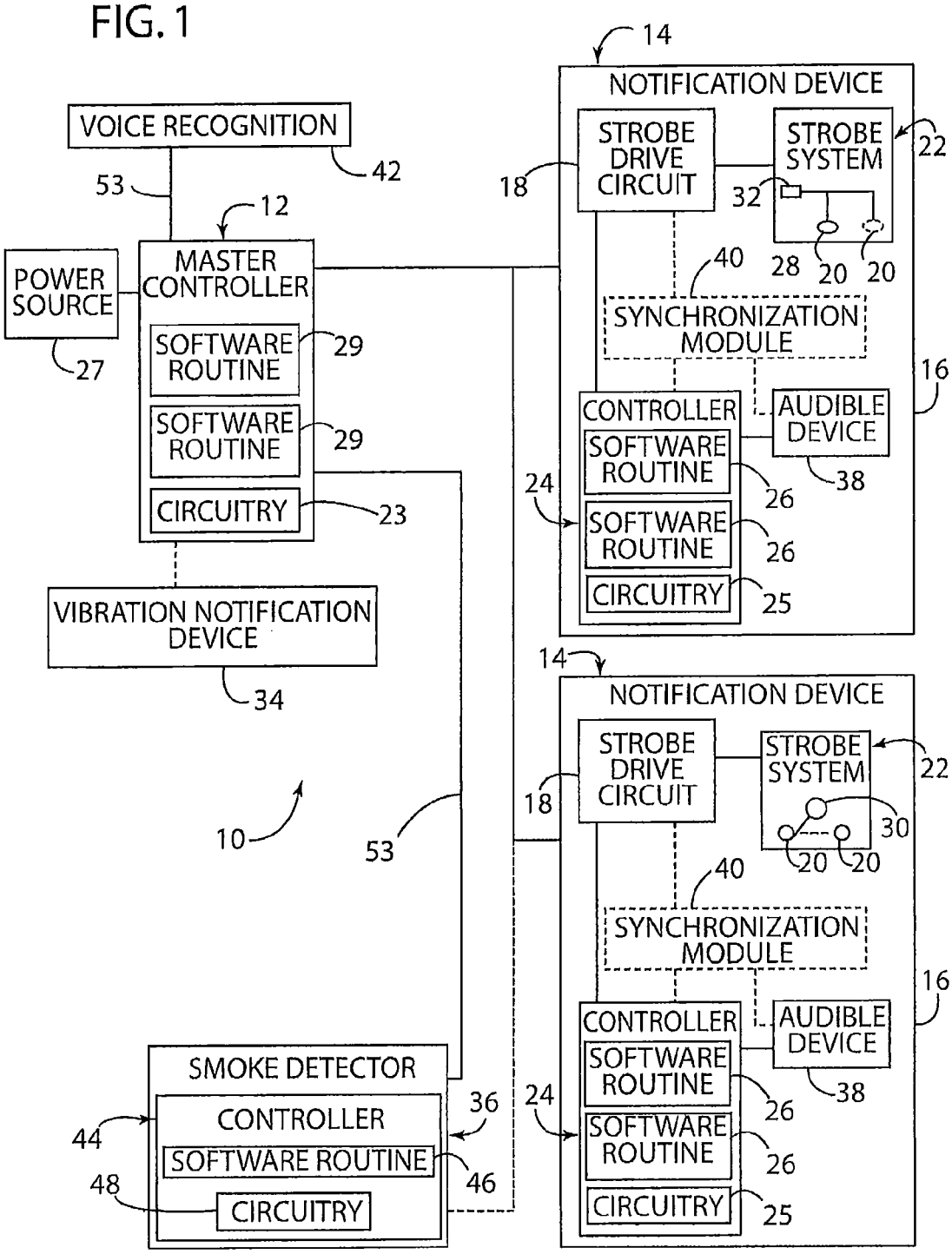
FIG. 1 is a block diagram of a notification system, in accordance with one embodiment of the present invention.
Figure 2:
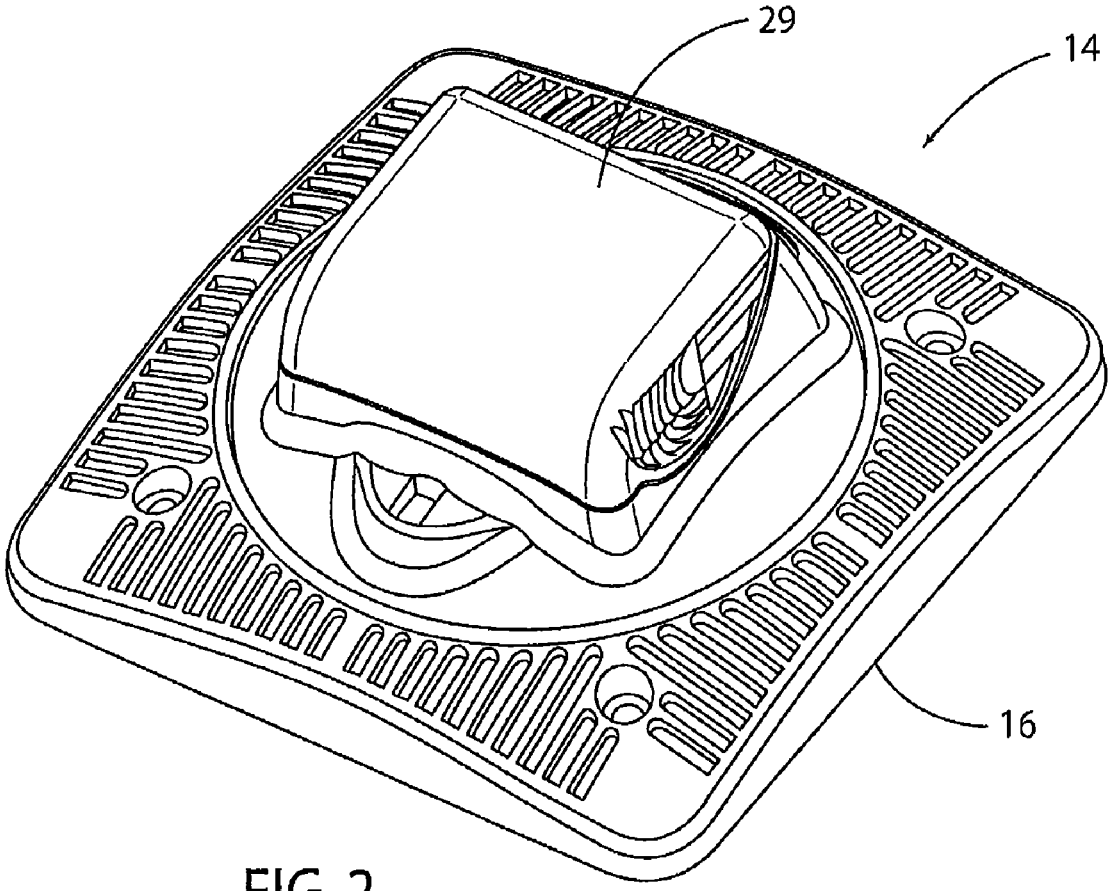
FIG. 2 is a front-side perspective view of a notification device, in accordance with one embodiment of the present invention.

Reference will now be made in detail to present preferred embodiments of the invention, examples of which are illustrated in the accompanying drawings. Wherever possible, the same reference numerals will be used throughout the drawings to refer to the same or like parts.

For purposes of description herein, the terms "upper," "lower," "right," "left," "rear," "front," "vertical," "horizontal," "top," "bottom," and derivatives thereof shall relate to the invention as shown in the drawings. However, it is to be understood that the invention may assume various alternative orientations, except where expressly specified to the contrary. It is also to be understood that the specific device illustrated in the attached drawings and described in the following specification is simply an exemplary embodiment of the inventive concepts defined in the appended claims. Hence, specific dimensions, proportions, and other physical characteristics relating to the embodiment disclosed herein are not to be considered as limiting, unless the claims expressly state otherwise.

In regards to FIGS. 1-8, a notification system is generally shown in FIG. 1 at reference identifier 10. The notification system 10 includes a master controller 12 and a notification device generally indicated at 14. According to one embodiment, the master controller 12 controls and monitors a plurality of notification devices generally indicated at 14. Typically, the notification device 14 notifies at least one person of an emergency situation in the general area of the notification device 14, such as, but not limited to, a fire, a terrorist attack, hazardous weather, a biohazard situation, the like, or a combination thereof. In such an embodiment, the notification system 10 can be used within a building structure or dwelling, wherein an emergency situation can be detected that activates one or more notification devices 14 in the building structure or substantially all of the notification devices 14 in the building structure.

Figure 3:
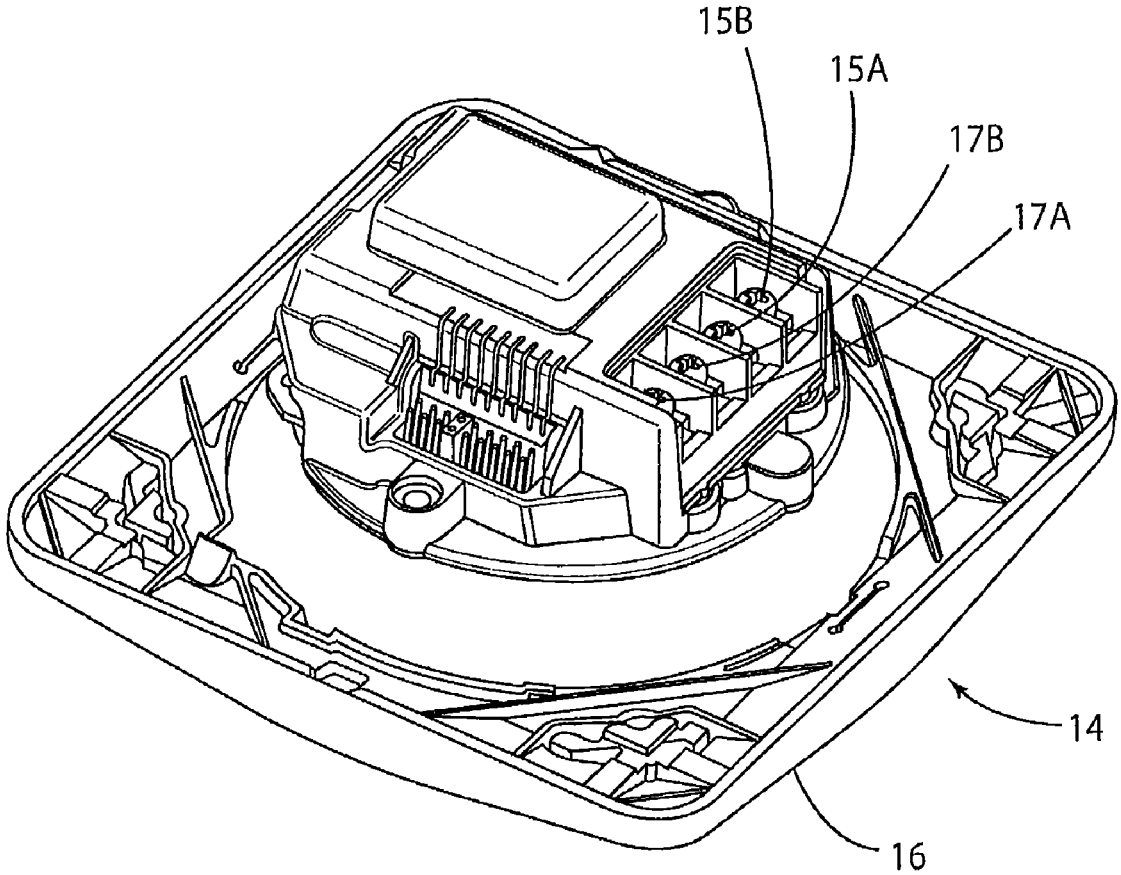
FIG. 3 is a rear-side perspective view of a notification device, in accordance with one embodiment of the present invention.
Figure 7:
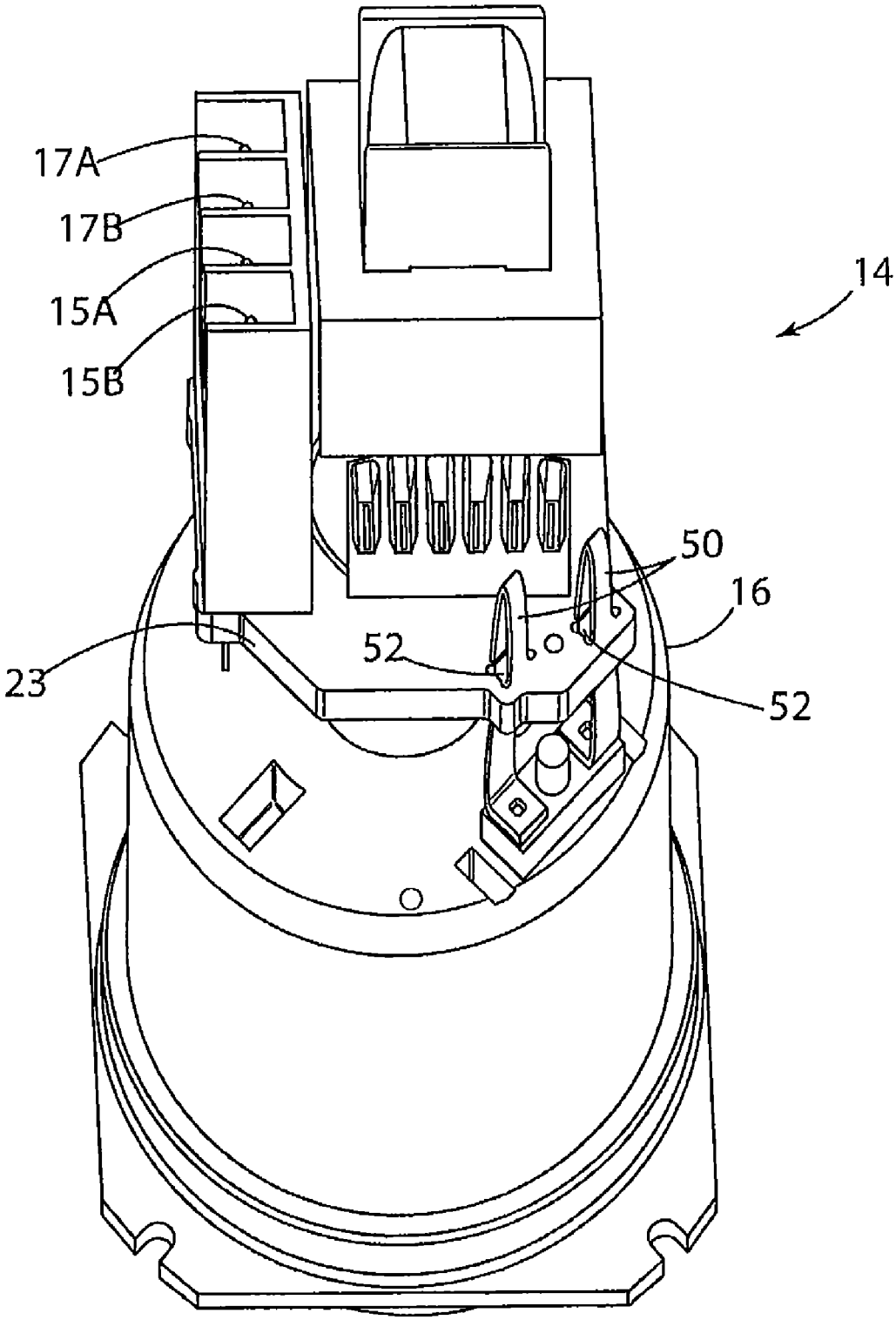
FIG. 7 is a rear-side perspective view of a notification device, in accordance with one embodiment of the present invention.

According to one embodiment, the notification device 14 includes an enclosure 16 (FIGS. 2-4, 7, and 8) that accepts an electrical connection from the master controller 12 (FIGS. 1 and 3), such that the master controller 12 can provide control signals and electrical power to the notification device 14. Typically, as shown in FIGS. 3 and 7, the notification device 14 includes a strobe positive connector 15A, a strobe negative connector 15B, a speaker or audible device positive connector 17A, and a speaker negative connector 17B. In such an embodiment, four electrical conductors electrically connect the master controller 12 to the notification device 14, so that the electrical power and signal are communicated or propagated between the master controller 12 and the notification device 14 by the four electrical conductors.

The notification device 14, as shown in FIG. 1, can further include at least one strobe drive circuit generally indicated at 18 that is configured to provide an electrical signal for periodically flashing at least one strobe 20. The notification device 14 can also include a strobe system generally indicated at 22 that is in communication with the strobe drive circuit 18, wherein the strobe system 22 is configured to flash the at least one strobe 20 in one of at least two different colors. A controller generally indicated at 24 can be included in the notification device 14, wherein the controller 24 is in communication with the master controller 12, and is configured to determine which color of the at least two different colors to flash the strobe 20 based upon a signal received from the master controller 12, as described in greater detail herein.

The controller 24 can include hardware circuitry 25 and one or more software routines 26, which can be executed based upon the control signal received from the master controller 12. The controller 24 can implement the hardware circuitry 25, the one or more executable software routines 26, or a combination thereof, to generate a control signal for controlling the flashing of the strobe 20. In such an embodiment, the strobe drive circuit 18 receives a command signal from the controller 24, which is communicated to the strobe system 22 along with electrical power, such that said strobe system 22 can flash the strobe 20. Typically, the strobe drive circuit 18 converts the received electrical power, such that the supplied electrical power to the strobe system 22 is suitable for flashing the strobe 20. Additionally or alternatively, the master controller 12 can include hardware circuitry 23, one or more executable software routines 29, or a combination thereof for communication with the notification device 14. It should be appreciated that the master controller 12 and/or the controller 24 can include a memory device or be in communication with a memory device, wherein the memory device stores the one or more executable software routines 26,29.

The electrical power supplied by the strobe drive circuit 18 to the strobe system 22 can be supplied by the master controller 12, which receives the electrical power supplied from a suitable power source 27. It should be appreciated that the power source 27 can be a separate device as the master controller 12 or the power source 27 can be integrated with the master controller 12. Alternatively, the notification device 14 can receive electrical power that is supplied directly to the notification device 14, such that the electrical power is not supplied from the master controller 12. In such an embodiment, the strobe drive circuit 18 can include or be in electrical communication with a suitable power source.

Figure 11:
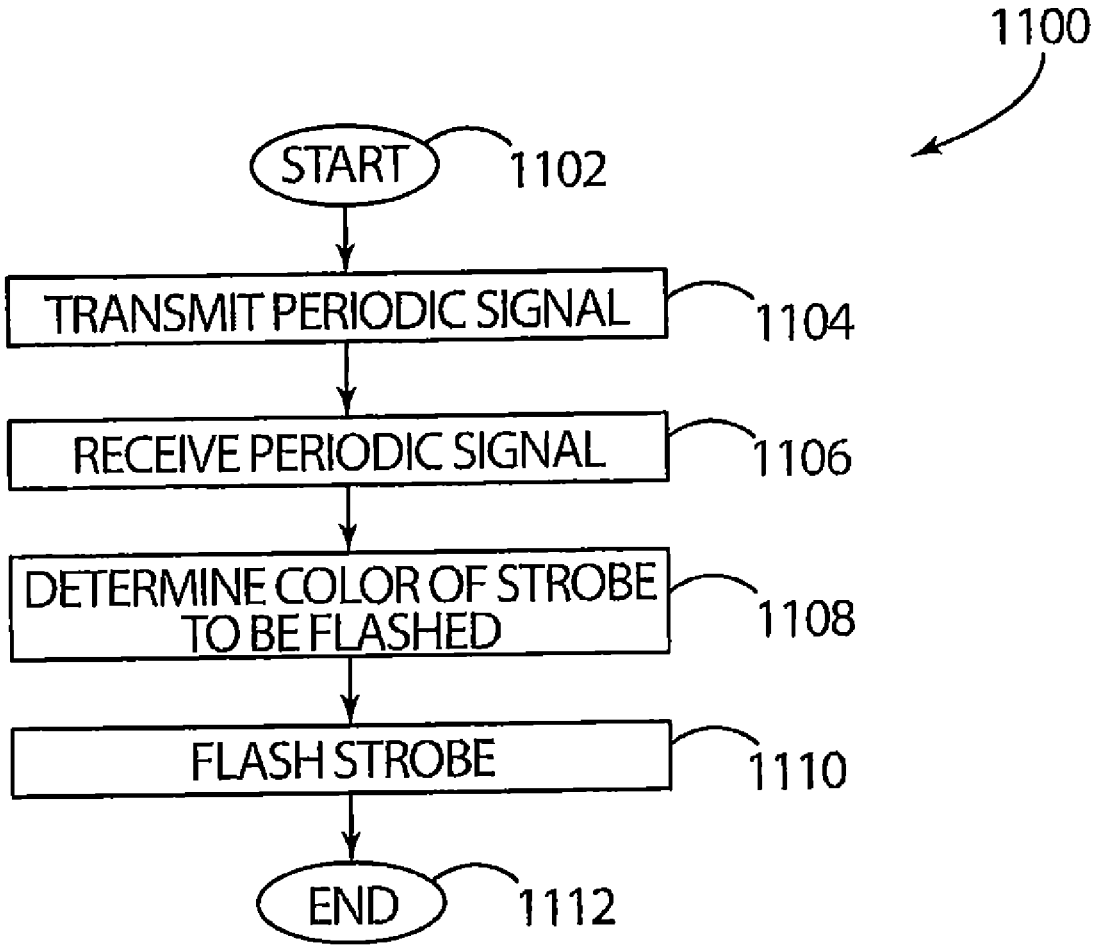
FIG. 11 is a flow chart illustrating a method of visual notification of different types of events by flashing different colors, in accordance with one embodiment of the present invention.

With respect to FIGS. 1 and 11, a method of visual notification of different types of events by flashing different colors is generally shown in FIG. 11 at reference identifier 1100. The method 1100 starts at step 1102, and proceeds to step 1104, wherein a periodic signal is transmitted. Typically, the periodic signal is transmitted from the master controller 12. At step 1106, the periodic signal is received, such that the periodic signal can be received by the notification device 14, according to one embodiment. The method 1100 then proceeds to step 1108, wherein the color of the strobe to be flashed is determined. Typically, the controller 24 executes one or more software routines 26 based upon the received periodic signal to determine which strobe 20 is to be flashed. At step 1110, the strobe 20 is flashed, and the method 1100 ends at step 1112. According to one embodiment, the strobe system 22 flashes the strobe 20 that is selected based upon the received periodic signal.

The color of the light emitted by a strobe can be manipulated in several ways. In one exemplary embodiment, a lens 29 (FIG. 2) covering the strobe 20 is a particular color, such that any light emitted by the strobe 20 appears to be the color of the lens. In such an embodiment, the emitted light that propagates through the lens 29 can be minimal when compared to the light emitted by the strobe 20 (e.g., much of the light is attenuated), since only the portion of the emitted light that has a wavelength that corresponds to the color of the lens 29 propagates through the lens 29.

In another exemplary embodiment, the light being emitted by the strobe 20, when the strobe 20 is an LED, can be controlled based upon an LED chip that is included in the LED. In such an embodiment, the strobe system 22 includes the strobe 20 that has one (1) LED that includes a plurality of LED chips, wherein a selected LED chip illuminates the LED based upon the control signal received from the master controller 12 by the controller 24. Thus, the strobe 20 can be flashed in one color of a plurality of colors by utilizing a particular LED chip included in the LED. One exemplary system is U.S. Patent Application Publication No. 2004/0239243 A1, the entire disclosure of which is hereby incorporated herein by reference.

Yet another exemplary embodiment is where the strobe system 22 includes a plurality of LEDs, each being a single LED chip that corresponds to a single color, such that each LED and corresponding LED chip are a different color. In such an embodiment, the strobe 20 flashes one of a plurality of LEDs that emits light based upon which LED chip the LED includes and the signal received by the notification device 14 from the master controller, so that a particular LED is illuminated based upon the particular emergency situation detected. According to one embodiment, the strobe 20 can include a first set of at least one LED and a second set of at least one LED, wherein the color of light emitted by the first set of at least one LED differs from the color of light emitted from the second set of at least one LED. Typically, each of the at least two different colors is determined by a ratio of electrical power supplied to the first set of at least one LED and the second set of at least one LED. Thus, the intensity of illumination of the first and second sets of at least one LED can be varied by the ratio of electrical power supplied to the first and second sets of at least one LED, which results in the apparent change in color of the light being emitted from the notification device 14. By way of explanation and not limitation, the strobes 20 can be configured to emit light at wavelengths having a predetermined color, such as, but not limited to, white, amber, yellow, blue, other visible wavelengths, non-visible wavelengths, the like, or a combination thereof.

Figure 4:
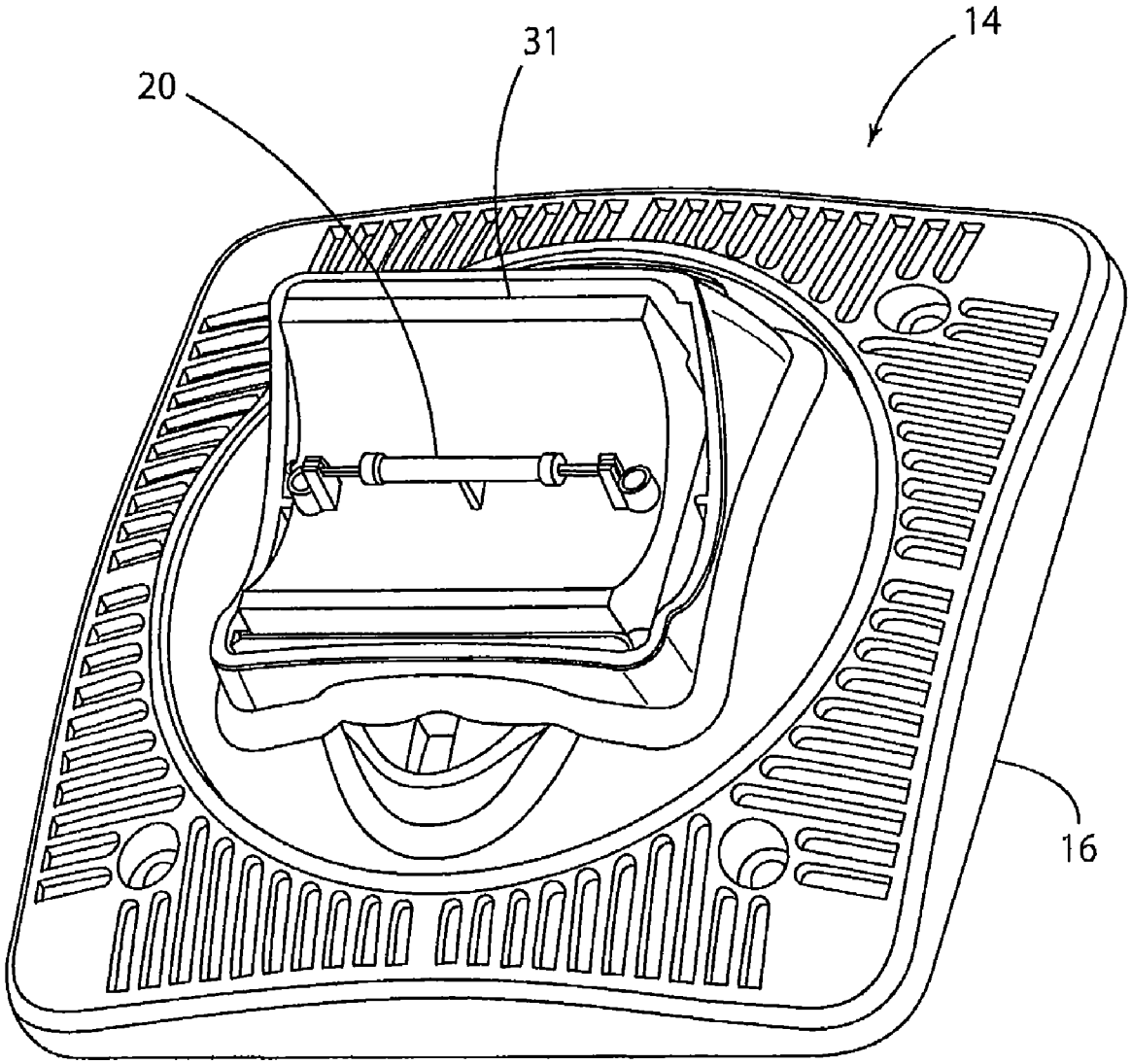
FIG. 4 is a front-side perspective view of a notification device with a lens element removed, in accordance with one embodiment of the present invention.
Figure 5:
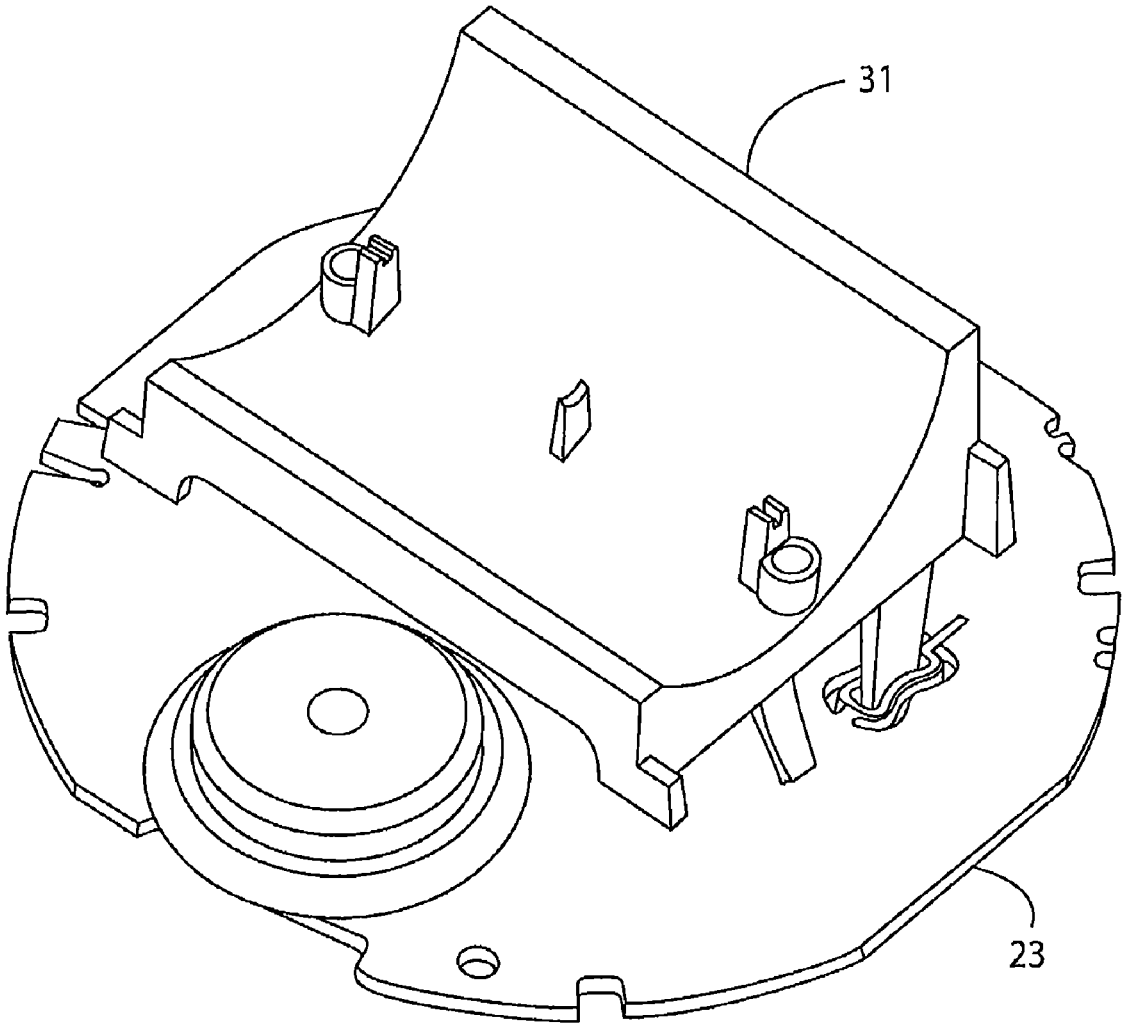
FIG. 5 is a top-front perspective view of a hardware circuitry and a reflector of a notification device, in accordance with one embodiment of the present invention.
Figure 6:
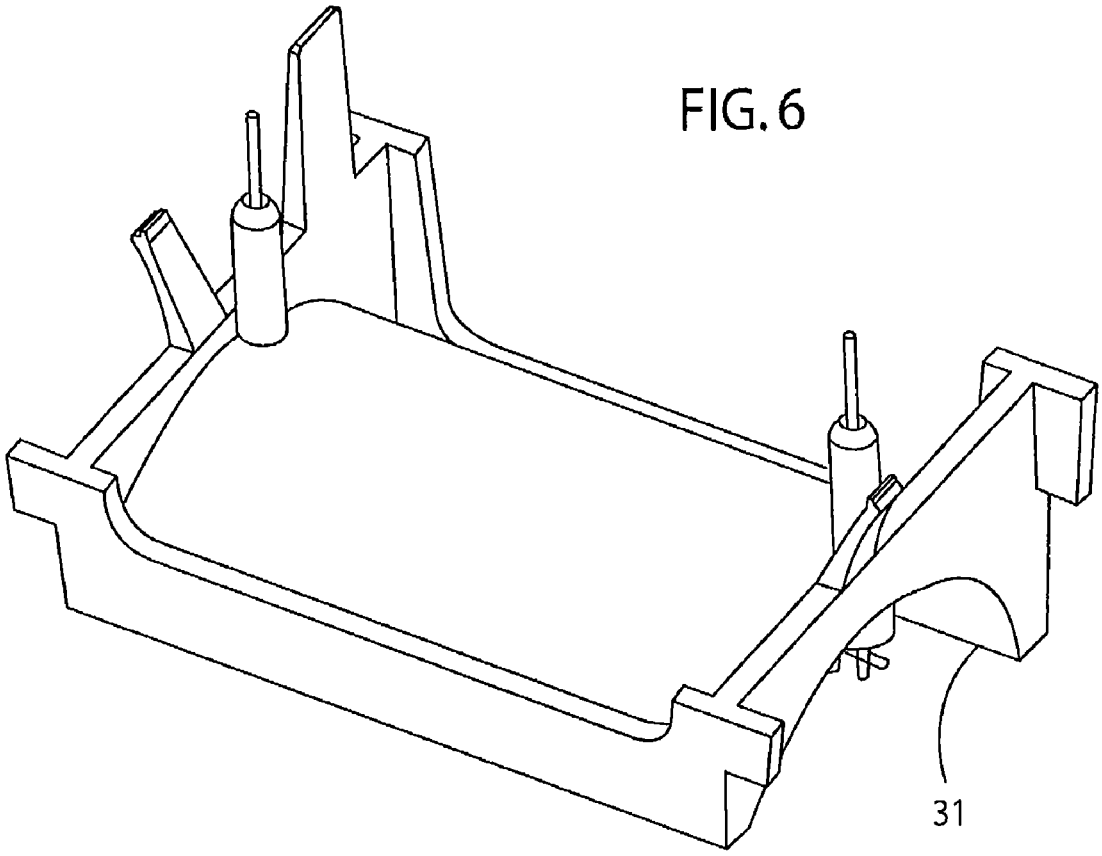
FIG. 6 is a rear-side perspective view of a reflector of a notification device, in accordance with one embodiment of the present invention.

According to an alternate embodiment, as shown in FIG. 4, the strobe 20 can include at least one Zenon tube. With respect to FIGS. 1 and 4, the strobe system 22 can include a Zenon tube for each color of light to be emitted. In such an embodiment, the strobe system 22 can include at least one switch device 30 to switch between a plurality of strobes 22 or Zenon tubes. For purposes of explanation and not limitation, the switch device 30 can be, but is not limited to, a relay. Thus, the controller 24 receives the control signal from the master controller 12, and commands the switch device 30, via the strobe drive circuit 18, to switch to one of the Zenon tubes, such that the selected Zenon tube is illuminated.

Typically, the notification device 14 includes a reflector 31 (FIGS. 4 and 5) positioned to reflect light emitted by the strobe 20 in a predetermined direction. According to one embodiment, when the strobe 20 is a Zenon tube, the reflector 31 is at least partially made of chrome, wherein the chrome can be electrically charged to ionize the gas of the Zenon tube, such that the Zenon tube flashes and emits light. Typically, the reflector 31 can be electrically charged by receiving electrical power from the strobe drive circuit 18, the master controller 12, the power source 27, or a combination thereof. Further, the chrome can facilitate the reflection of the light emitted from the Zenon tube.

The strobe system 22 can include an energy storage device 32 that stores electrical power, such that the stored electrical power is rapidly discharged to flash the strobe 20, according to one embodiment. The master controller 12 can provide electrical power to the energy storage device 32 at a substantially constant electrical current, and the energy storage device 32 then rapidly discharges in order to supply sufficient electrical power to flash the strobe 20. Thus, when flashing a plurality of strobes 20 in a plurality of notification devices 14 substantially simultaneously, a surge of electrical power is not drawn from the master controller 12, or the power source 27, at the time of flashing the plurality of strobes 20. Instead, the energy storage device 32 is continuously charged and discharged, such that electrical power is continuously drawn in a smaller quantity to the energy storage device 32, when compared to the electrical current that would be drawn from the master controller 12 or the power source 27 at the time each of the strobes 20 are flashed if the energy storage device 32 were not implemented. For purposes of explanation and not limitation, the energy storage device 32 can be, but is not limited to, a capacitor.

Figure 8:
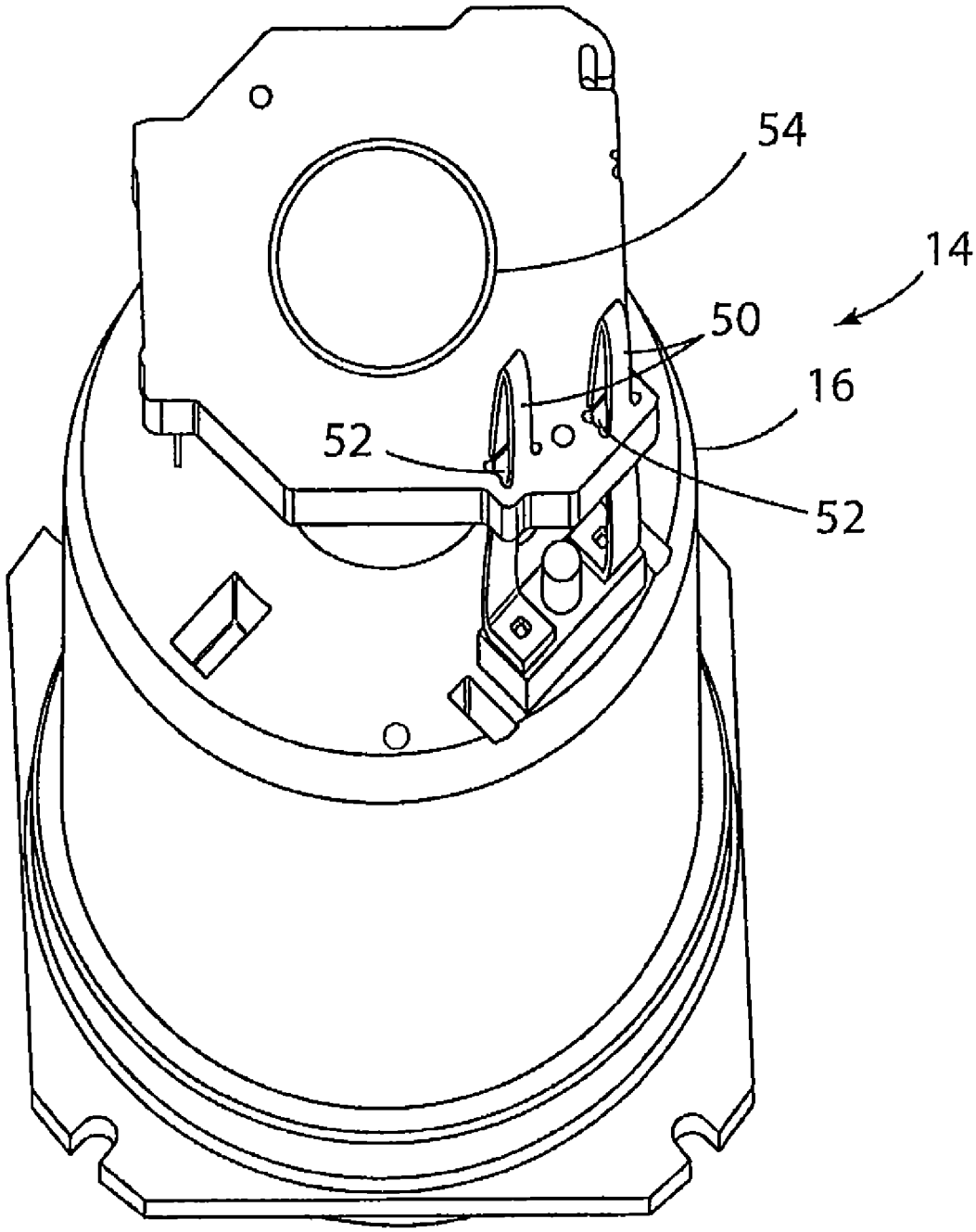
FIG. 8 is a rear-side perspective view of a notification device, with a portion containing a strobe positive and negative connector and a speaker positive and negative connector removed, in accordance with one embodiment of the present invention.

The electrical connector that electrically connects the master controller 12 to the notification device 14 can include a plurality of conductors, wherein a first conductor transmits electrical power from the master controller 12 to the notification device 14 (e.g., the strobe positive and negative contacts 15A,15B), and a second conductor transmits the control signal from the master controller 12 to the notification device 14 (e.g., the speaker positive and negative contacts 17A,17B). According to one embodiment, the hardware circuitry 23 (e.g., a circuit board) (FIG. 5) that communicates the electrical power received by the strobe connectors 15A,15B to flash the strobe 20 (e.g., charge the reflector 31 when the strobe 20 is a Zenon tube) can be mechanically and electrically connected to the reflector 31 by at least one connector 50 (FIGS. 7 and 8). Typically, the connector 50 is a snap-fit connector that is inserted through an aperture 52 of the hardware circuitry 23, such that the connector 50 mechanically locks and electrically connects with the hardware circuitry.

With respect to FIG. 1, a vibration notification device 34 can also be included in the notification system 10, according to one embodiment. The vibration notification device 34 can be configured to vibrate based upon a signal received from the master controller 12. Typically, the vibration notification device 34 wirelessly communicates with the master controller 12. By way of explanation and not limitation, the master controller 12 can communicate with the vibration notification device 34 using a wireless connection, such as, but not limited to, a Wi-Fi connection, a BLUETOOTH™ connection, a ZIGBEE™ connection, a cellular connection, a radio frequency (RF) signal, an infrared (IR) signal, another suitable wireless signal capable of transmitting data, or a combination thereof.

In such an embodiment, the vibration notification device 34 is mobile, such that master controller 12 includes a transmitter that communicates a signal to the vibration notification device 34, such that the vibration notification device 34 vibrates when the master controller 12 transmits the control signal to the notification device 14 commanding the strobe system 22 to flash the strobe 20. Thus, the vibration notification device 34 can be a mobile device that is remote or separate from the notification device 14, and worn by a person having a hearing impairment, a vision impairment, another disability or impairment that prevents the person from being notified by the notification device 14, or a combination thereof, so that the person will be notified by a device other than the notification device 14 when the notification system 10 detects an emergency situation. According to one embodiment, the vibration notification device 34 is operated within the building structure that contains the notification system 10.

Additionally or alternatively, in such an embodiment that includes at least one vibration notification device 34, at least a portion of the notification devices 14 can include a transmitter to communicate a signal to the vibration notification device 34, such that the vibration notification device 34 vibrates when the master controller 12 transmits the control signal to the notification device 14 commanding the strobe system 22 to flash the strobe 20. The notification device 14 can be commanded by the master controller 12 to transmit the signal to the vibration notification device 34, such that when the master controller 12 commands the notification device 14 to flash the strobe 20, the master controller 12 commands the notification device 14 to transmit the signal to the vibration notification device 34. Typically, when a plurality of notification devices 14 are spatially located throughout at least a portion of a building structure, the signal transmitted by the notification device 14 has a lower signal strength when compared to the signal strength of the signal communicated from the master controller 12 to the vibration notification device 34.

According to an alternate embodiment, the vibration notification device 34 can be used by a person distant from the building structure that contains the notification system 10, so long as the vibration notification device 34 is capable of receiving the control signal from the master controller 12. In such an embodiment, the person using the vibration notification device 34 is informed when the notification system 10 is notifying people in the building structure containing the notification system 10 of an emergency situation. For purposes of explanation and not limitation, the person using the vibration notification device 34 in such an embodiment, can be someone who wants to be notified of a detected emergency situation of another location (e.g., an elderly parent's dwelling).

According to one embodiment, the notification system 10 (FIG. 1) can include a smoke detector device generally indicated at 36 that is in communication with the master controller 12, such that the notification device 14, the vibration notification device 34, or a combination thereof are activated when the smoke detector device 36 detects smoke. Exemplary smoke detector devices are disclosed in U.S. Pat. No. 6,876,305, entitled "COMPACT PARTICLE SENSOR," U.S. Pat. No. 6,653,942, entitled "SMOKE DETECTOR," U.S. Pat. No. 6,326,897, entitled "SMOKE DETECTOR," and U.S. Pat. No. 6,225,910, entitled "SMOKE DETECTOR," the entire disclosures of which are hereby incorporated herein by reference.

According to one embodiment, the notification system 10 (FIG. 1) is a power over Ethernet (PoE) system, wherein the master controller 12 and at least one smoke detector 36 are connected via an Ethernet connection 53. Typically, the smoke detector 36 is powered over the Ethernet connection 53 from the master controller 12, in addition to the signal being transmitted between the master controller 12 and the smoke detector 36 through the Ethernet connection 53. By way of explanation and not limitation, the master controller 12 and at least one smoke detector 36 are electrically connected by category five (CAT5) wire or greater, or other suitable electrical connector for transmitting electrical power and a data signal, such as, but not limited to, CAT5e, CAT6, CAT7, or a combination thereof. Additionally, a plurality of smoke detectors 36 can be electrically connected in parallel to the master controller 12 by the electrical connector forming the Ethernet connection 53.

For purposes of explanation and not limitation, a CISCO™ powered switch can be used to control the electrical power, the signal being communicated between the master controller 12 and the smoke detector 36, or a combination thereof. It should be appreciated that other suitable switches or controllers can be used, such as, but not limited to, switches or controllers that utilize the IEEE 802.3AF protocol, a PoE plus protocol (e.g., IEEE P802.3AT), other suitable protocols, or a combination thereof. Additionally or alternatively, the smoke detector 36 can include a controller generally indicated at 44 having hardware circuitry 46, one or more executable software routines 48, or a combination thereof for communicating with the master controller 12 and detecting smoke. In such an embodiment, the controller 44 can receive updates to the one or more software routines 48 over the Ethernet connection 53. Further, the smoke detectors 36 can be tested from a remote location, such as, but not limited to, troubleshooting a malfunction, scheduled testing, the like, or a combination thereof. Alternatively, the smoke detector 36 can be electrically connected to the master controller 12 via the electrical connections from connecting the master controller 12 and the notification devices 14.

The notification device 14 (FIG. 1) can further include an audible device 38, such as, but not limited to, a horn, configured to emit an audible noise using a speaker based upon a signal received from the master controller 12, according to one embodiment. The audible device 28 can include a magnet 54 (FIG. 8), such that the audible device 28 emits an audible noise. By way of explanation and not limitation, the magnet 54 is a neodymium magnet. The flashing of the strobe 20 and the audible noise emitted from the audible device 38 can be substantially synchronized even when an operating protocol of the master controller 12 differs from an operating protocol of the notification device 14, as described in greater detail herein. In one exemplary embodiment, the notification device 14 includes a synchronization module 40 configured to interrupt a power signal communicated from the master controller 12, and to provide a signal having a predetermined pulse to the strobe drive circuit 18 and the audible device 38.

Additionally or alternatively, the notification system 10 (FIG. 1) can include a voice recognition device 42, wherein a user of the notification system 10 can verbally input commands with the voice recognition device 42. The voice recognition device 42 can include a microphone, a telephone device in communication with a telephone system, the like, or a combination thereof. According to one embodiment, wherein the notification system 10 is a PoE system, the voice recognition device 42 can receive electrical power supplied from the master controller 12 and communicate a signal between the master controller 12 and the voice recognition device 42 via the Ethernet connection 53.

Figures 9A, 9B:
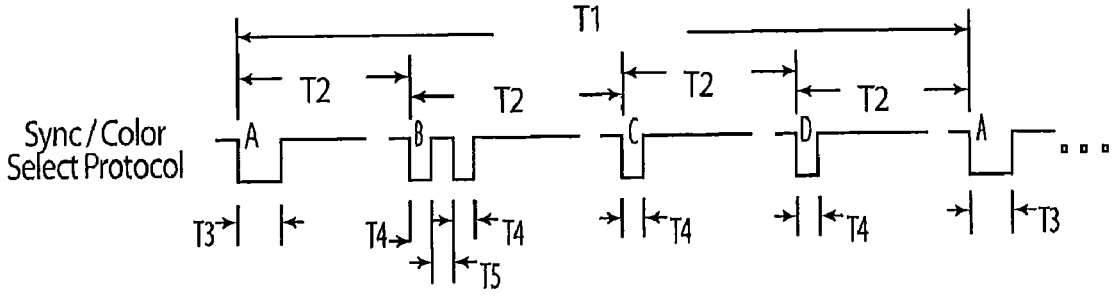
FIGS. 9A and 9B are diagrams illustrating an exemplary timing algorithm for substantially synchronizing a flashing of a strobe and emitting an audible noise when a protocol of a received signal is different than an operating protocol of a notification device, in accordance with one embodiment of the present invention.

As shown in FIGS. 1, 9A, and 9B, the flashing of the strobe 20 and the emittance of the audible noise by the audible device 38 can be synchronized when the master controller 12 is operating using a different protocol than the notification device 14 (e.g., the master controller 12 and the notification device 14 are manufactured by different manufacturers), wherein the strobe 20 is configured to emit light having multiple colors, according to one embodiment. By way of explanation and not limitation, the synchronization of the strobe 20 and the audible device 38 can be shown over a four second (4 s) temporal pattern period ($T_1$). A first period of time within the four second (4 s) temporal pattern period ($T_1$) is an approximately one second (1 s) flash/sync rate time period ($T_2$). Typically, the four second (4 s) temporal pattern period ($T_1$) includes four (4) consecutive flash/sync rate time periods ($T_2$). At least a portion of the flash/sync rate time period ($T_2$) includes a second time period within the four second (4 s) temporal pattern period ($T_1$) that is an approximately thirty milliseconds (30 ms) mute pulse time period ($T_3$). Typically, the mute pulse time period ($T_3$) includes pulse A, wherein the audible device 38 is mute and the strobe 20 flashes.

One of the consecutive flash/synch rate time periods ($T_2$) can include a third time period that is an approximately fifteen milliseconds (15 ms) sync pulse time period ($T_4$) and a fourth time period that is an approximately forty to two hundred fifty milliseconds (40 ms-250 ms) color selection time period ($T_5$). Typically, the sync pulse time period ($T_4$) can include one of pulse B, pulse C, or pulse D, and the color selection time period ($T_5$) is a time period between pulses (e.g., pulse B), wherein the color of the strobe 20 to be flashed is determined. Pulses C and D can be pulses, wherein the strobe 20 is flashed and the audible device 28 emit an audible noise substantially simultaneously.

Figure 10A:
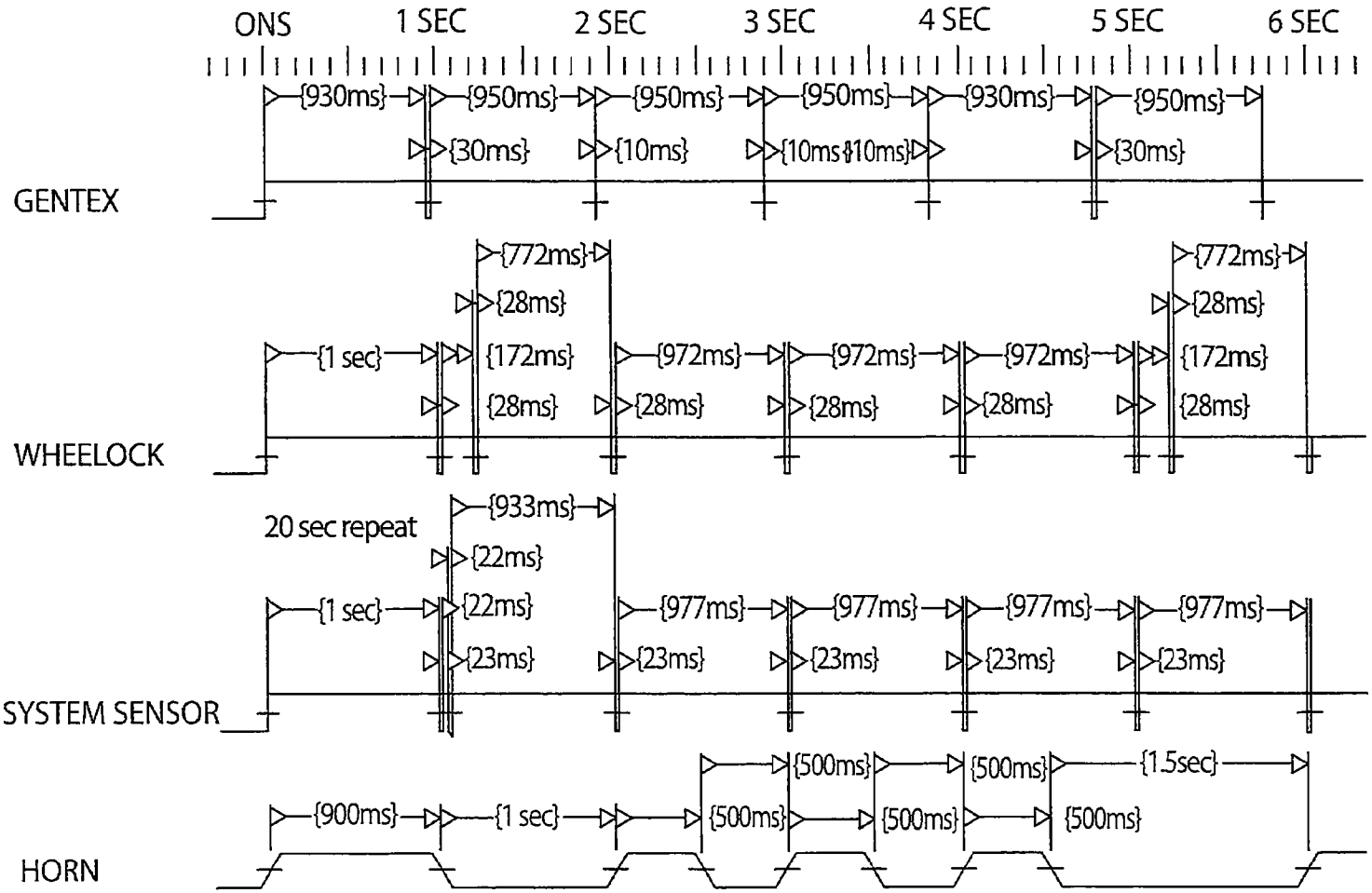
FIGS. 10A and 10B are diagrams illustrating exemplary timing algorithms for flashing a strobe and emitting an audible noise from a plurality of notification devices that are each manufactured by a different manufacturer and operate with a different operating protocol.
Figure 10B:
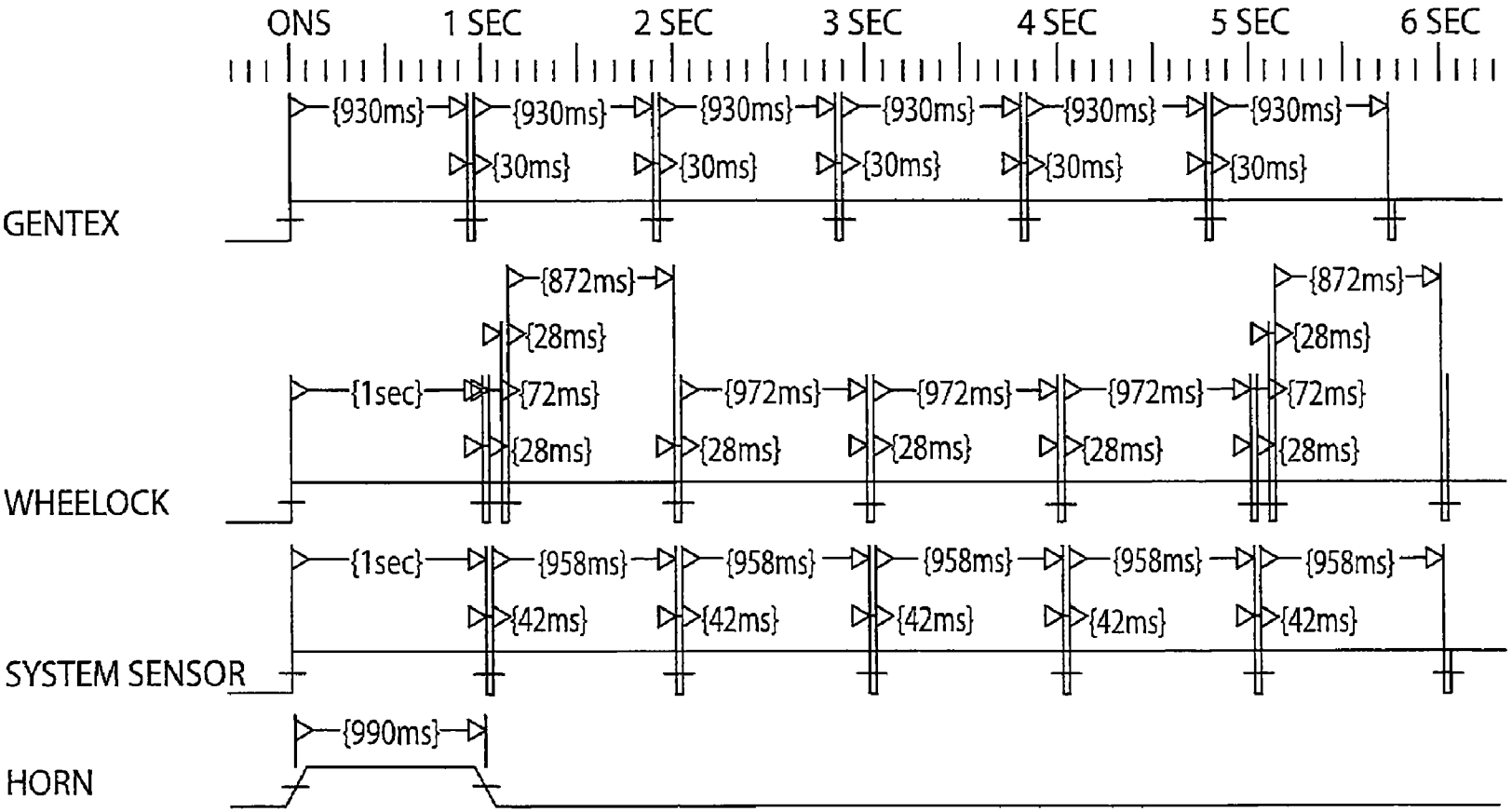

In regards to FIGS. 1 and 10A-10G, according to one embodiment, a method for synchronizing the strobe 20 and the audible device 38 is generally shown in FIG. 10D at reference identifier 100, wherein the strobe 20 is configured to emit light having a single color (e.g., white light). In such an embodiment, the method 100 can be utilized to synchronize the flashing of the strobe 20 and the emittance of the audible noise by the audible device 38 when the master controller 12 is operating using a different protocol than the notification device 14 (e.g., the master controller 12 and the notification device 14 are manufactured by different manufacturers). Exemplary timing diagrams for controlling the flashing of the strobe 20 and the emittance of the audible noise by the audible device 38 of different manufacturers is illustrated in FIGS. 10A and 10B. The exemplary protocols of FIGS. 10A and 10B can be determined, such that the audible noise or horn state can be recognized, as shown in FIG. 10C.

With respect to FIG. 10D, the method 100 can implement the pattern recognition (FIG. 10C) to provide synchronization between the strobe 20 and the audible device 38. The method 100 starts at step 102, and proceeds to step 104, wherein the notification system 10 is initialized. At step 106, a one millisecond (1 ms) service is performed. The method 100 can return to step 106, wherein the one millisecond (1 ms) service is repeated, and the method 100 can then end at step 108. Typically, step 106 is performed every one millisecond (1 ms), wherein it takes approximately one millisecond (1 ms) to perform step 106.

In regards to FIG. 10E, the one millisecond (1 ms) service step is generally shown at 106, and includes the step 110 of debouncing a synchronization input. Typically, debouncing a synchronization input can be utilized when a switch having mechanical contacts is used, such that the state of the signal is monitored for a period of time before it is determined that the state of the signal has been altered. At decision step 112, it is determined if a new synchronization state is found. If it is determined at decision step 112 that a new synchronization state is found, then step 106 proceeds to step 114, wherein the synchronization is debounced. At step 116, the pulse timers are logged and reset, and the step 106 proceeds to decision step 118. However, if it is determined at decision step 112 that a new synchronization state is not found, then the step 106 proceeds to step 120, wherein no synchronous input is changed. The step 106 then proceeds to decision step 118.

At decision step 118, it is determined if synchronization inputs are high for two hundred fifty milliseconds (250 ms). If it is determined at decision step 118 that the synchronization input is high for approximately two hundred fifty milliseconds (250 ms), then the step 106 proceeds to step 122, wherein the audible device phase is evaluated. At step 124, the audible device phase is updated, and the step 106 proceeds to decision step 125. When it is determined at decision step 118 that a synchronization input is not high for two hundred fifty milliseconds (250 ms), then the step 106 proceeds to step 128, wherein the timer is not active, and to decision step 125. At decision step 125, it is determined if step 106 has been performed twenty-five (25) times. If it is determined at decision step 125 that step 106 has not been performed twenty-five (25) times, then step 106 returns to step 110. However, if it is determined at decision step 125 that step 106 has been performed twenty-five (25) times, then step 106 proceeds to step 126, wherein a twenty-five millisecond (25 ms) service is performed.

Figure 10F:
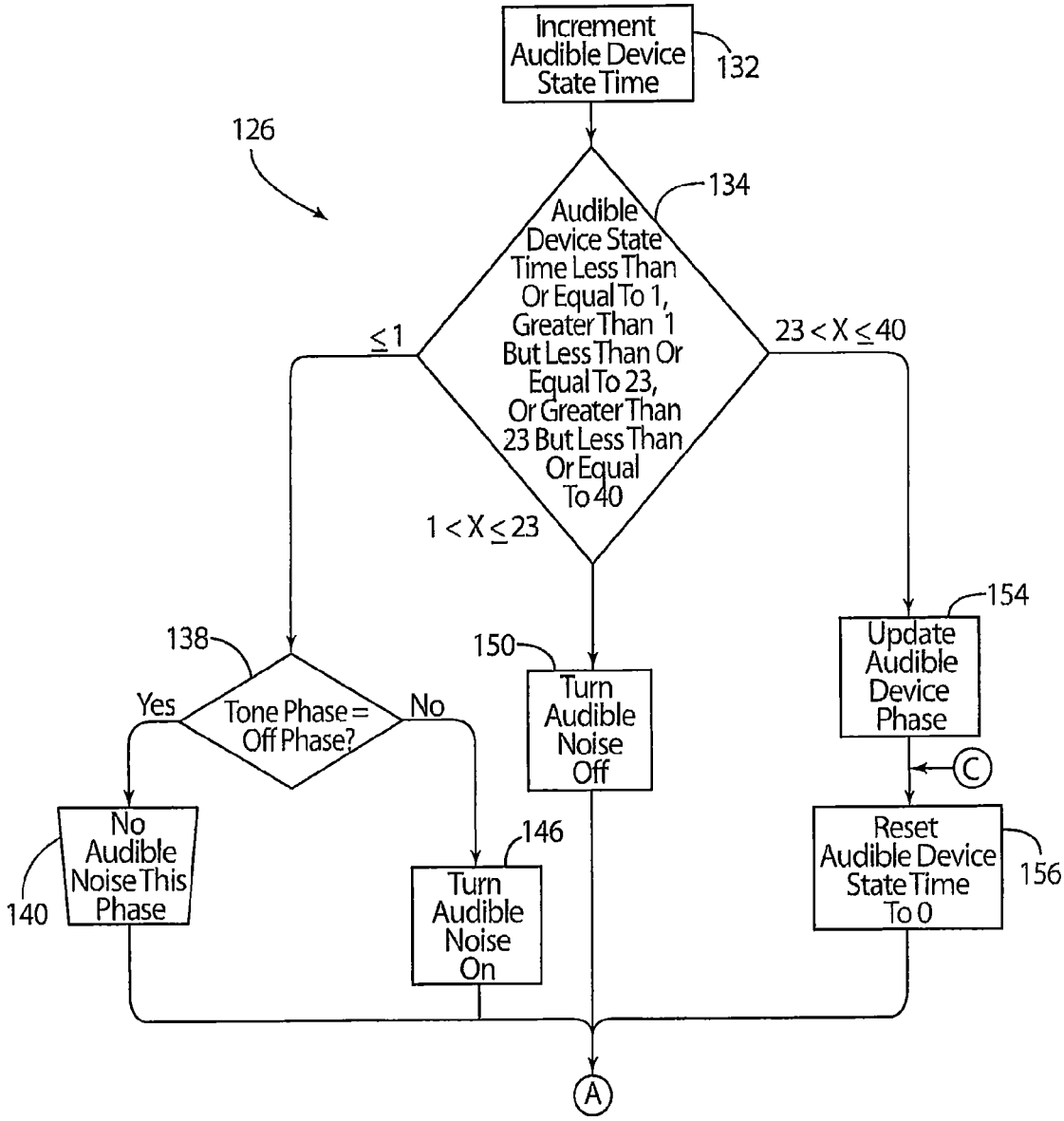

The twenty-five millisecond (25 ms) service step 126 is generally shown in FIG. 10F, and includes step 132, wherein the audible device state time is incremented. Typically, the audible device state time is a value that is incremented or decremented, wherein the value corresponds to an elapsed period of time. At decision step 134, it is determined if the audible device state time is less than or equal to one ($\leqq 1$), greater than one but less than or equal to twenty-three ($1<X\leqq 23$), or greater than twenty-three but less than or equal to forty ($23<X\leqq 40$). If it is determined at decision step 134 that the audible device state time is less than or equal to one ($\leqq 1$), then the step 126 proceeds to decision step 138, wherein it is determined if the tone phase equals the off phase. If it is determined at decision step 138 that the tone phase equals the off phase, then the step 126 proceeds to step 140, wherein the audible device 38 is not activated during that phase, such that no audible noise is emitted. After the step 140, the twenty-five millisecond (25 ms) service step 126 is completed, and the method 100 returns to the one millisecond (1 ms) service step 106. However, if it is determined at decision step 138 that the tone phase does not equal the off phase, then the step 126 proceeds to step 146, wherein the audible device 38 is activated such that an audible noise is emitted. After step 146, the twenty-five millisecond (25 ms) service step 126 is completed, and the method 100 returns to the one millisecond (1 ms) service step 106.

When it is determined at decision step 134 that the audible device state time is greater than one but less than or equal to twenty three ($1<X\leqq 23$), the step 126 proceeds to step 150, wherein the audible device 38 is turned off. After step 150, the twenty-five millisecond (25 ms) service step 126 is then completed, and the method 100 returns to the one millisecond (1 ms) service step 106. However, if it is determined at decision step 134 that the audible device state time is greater than twenty-three but less than or equal to forty ($23<X\leqq 40$), then the step 126 proceeds to step 154, wherein the horn phase is updated. Step 126 then proceeds to step 156, wherein the audible device state time is reset to zero (0). After step 156, the twenty-five millisecond (25 ms) service step 126 is completed, and the method 100 returns to the one millisecond (1 ms) service step 106. Typically, value twenty-three (23) for the audible device state time represents that approximately one-half a second (0.5 s) has elapsed since step 126 had been initially implemented, and the value forty (40) for the audible device state time represents that approximately one second (1 s) has elapsed since step 126 had been initially implemented.

Figure 10G:
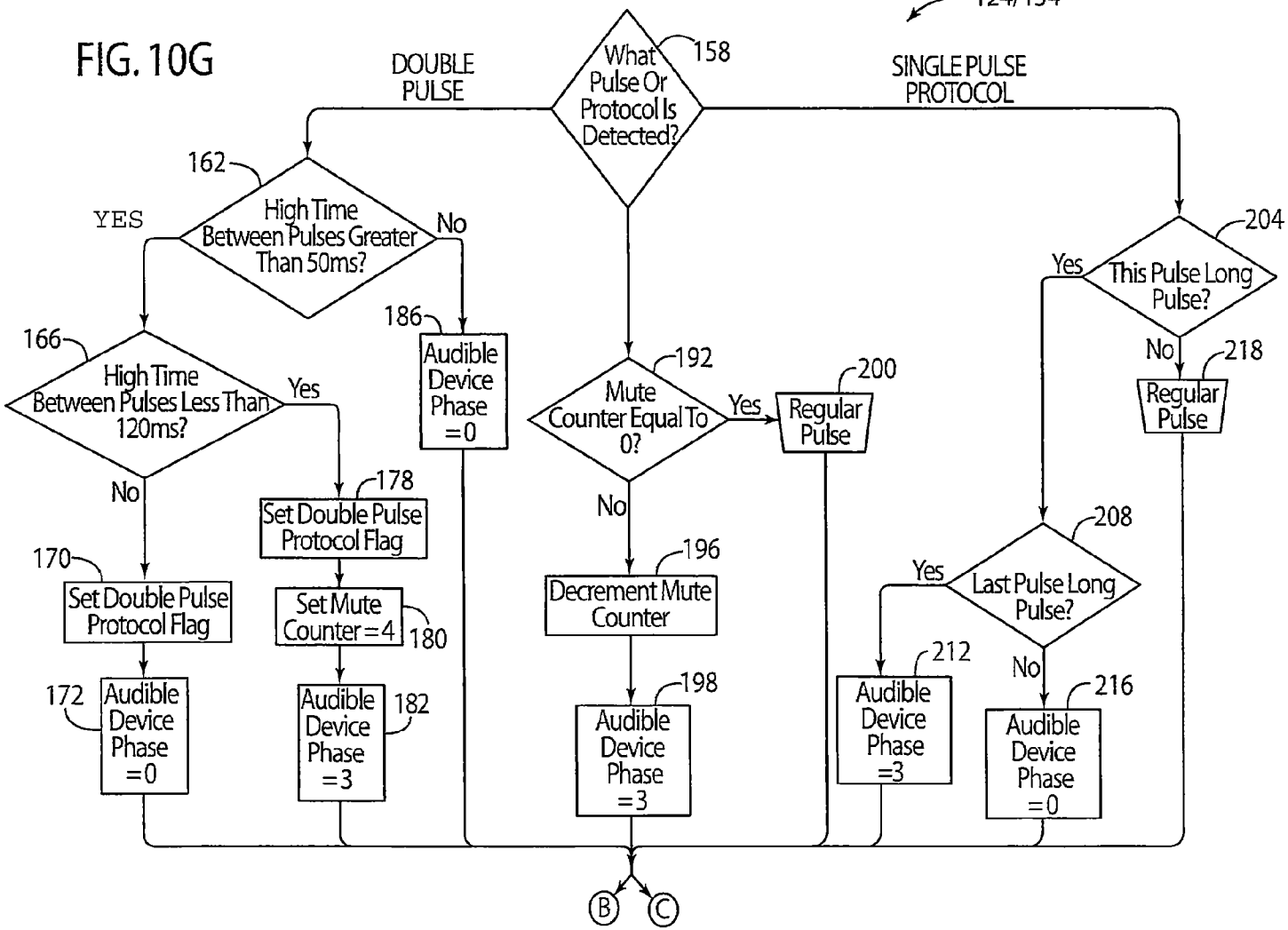

The updating of the audible device phase in steps 124 (FIG. 10E) and 154 (FIG. 10F) is generally shown in FIG. 10G. The steps 124 and 154 start at decision step 158, wherein the pulse and protocol are detected. If it is determined at decision step 158 that the detected pulse is a double pulse, then the steps 124 and 154 proceed to decision step 162. If it is determined at decision step 162 that a high time between pulses is greater than fifty milliseconds (50 ms), then the steps 124 and 154 proceed to decision step 166. At decision step 166, it is determined if a high time between pulses is less than one hundred twenty milliseconds (120 ms).

If it is determined at decision step 166 that a high time between pulses is not less than one hundred twenty milliseconds (120 ms), then the steps 124 and 154 proceed to step 170. At step 170, a double-pulse protocol flag is set, and at step 172, the audible device phase is set to equal zero (0). Typically, steps 170 and 172 are where the strobe 20 is flashed and the audible device 30 emit the audible noise substantially simultaneously (i.e., the strobe 20 and audible device 38 are substantially synchronized). After step 172, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F).

When it is determined at decision step 166 that the high time between pulses is less than one hundred twenty milliseconds (120 ms), then the steps 124 and 154 proceed to step 178, wherein a double-pulse protocol flag is set. At step 180, a mute counter is set to equal four (4), and at step 182, the audible device phase is set to equal three (3). Typically, steps 178, 180, and 182 are implemented during a period of silence, such that neither the strobe 20 is flashed nor does the audible device 38 emit an audible noise. After step 182, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F). When it is determined at decision step 162 that a high time between pulses is not greater than fifty milliseconds (50 ms), then the steps 124 and 154 proceed to step 186, wherein the audible device phase is set to equal zero (0). Typically, step 186 is where the strobe 20 is flashed and the audible device 38 emits the audible noise substantially simultaneously (i.e., the strobe 20 and the audible device 38 are substantially synchronized). After step 186, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F).

If it is determined at step 158 that a double-pulse protocol is present, then the steps 124 and 154 proceed to decision step 192. If it is determined at decision step 192 that a mute counter is not equal to zero (0), then the steps 124 and 154 proceed to step 196. At step 196, the mute counter is decremented, and at step 198, the audible device phase is set to equal zero (0). Typically, steps 196 and 198 are implemented during a period of silence, such that neither the strobe 20 is flashed nor does the audible device 38 emit an audible noise. After step 198, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F). However, if it is determined at decision step 192 that a mute counter is equal to zero (0), then the steps 124 and 154 proceed to step 200, wherein a regular pulse is emitted. After step 200, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F).

If it is determined at decision step 158 that a single pulse protocol is present, then the steps 124 and 154 proceed to decision step 204. At decision step 204, it is determined if the single pulse is a long pulse. If it is determined at decision step 204 that the single pulse is a long pulse, then the steps 124 and 154 proceed to decision step 208. At decision step 208, it is determined if the last pulse is a long pulse. Typically, decision step 208 is implemented to determine if the audible device should be muted.

If it is determined at decision step 208 that the last pulse is a long pulse, then the audible device phase is set to equal three (3) at step 212. Typically, step 212 is when the strobe 20 and audible device 38 are silent, such that the strobe 20 does not flash nor does the audible device 38 emit an audible noise. After step 212, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F). When it is determined at decision step 208 that the last pulse is not a long pulse, then the audible device phase is set to equal zero (0) at step 216. Typically step 216 is where the strobe 20 is flashed substantially simultaneously as the audible device 38 emits the audible noise (i.e., the strobe 20 and the audible device 38 are substantially synchronized). After step 216, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F).

However, if it is determined at decision step 204 that the pulse is not a long pulse, then the steps 124 and 154 proceed to step 218, wherein a regular pulse is emitted. After step 218, the steps 124 and 154 are then completed, such that if the method 100 is implementing step 124, then the method 100 proceeds to step 125 (FIG. 10E), and if the method 100 is implementing step 154, then the method 100 proceeds to step 156 (FIG. 10F).

Advantageously, the notification device 10 and method 1100 alert at least one person of a detected emergency situation by flashing at least one strobe 20 one of at least two different colors that indicates the type of emergency situation. Thus, the notification system 10 does not need to have a separate notification device 14 for each emergency situation that the notification system 10 can be used to alert people. Further, the notification system 10 can be a PoE system and include a smoke detector 36 that is connected to the master controller 12 over the Ethernet connection 53. Additionally, the notification system 10 can include the vibration notification device 34 for alerting a person of the detected emergency situation when the person is unable to be made aware of the detected emergency situation by the notification device 14. The notification system 10 can also substantially synchronize the flashing of the strobe 20 and the emittance of the audible noise by the audible noise device 38 when the protocol of the signal received by the notification device 14 is different than the operating protocol of the notification device 14. It should be appreciated that the notification device 10 and method 1100 can have additional or alternate advantages. It should further be appreciated that the components or elements of the notification system 10 can be combined in alternative ways.

The above description is considered that of preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A notification device comprising:

an enclosure accepting a plurality of conductors that supply both a signal and electrical power;

at least one strobe drive circuit configured to supply an electrical signal for periodically flashing at least one strobe;

a strobe system in communication with said strobe drive circuit, said strobe system configured to flash said at least one strobe, such that said strobe system flashes one of at least two different colors;

a controller in communication with at least one of said two conductors, wherein said controller is configured to determine which color of said at least two different colors to flash said at least one strobe based upon said signal received from at least one of said plurality of conductors; and an audible device configured to emit an audible noise based upon said signal received from at least one of said plurality of conductors, wherein said flashing of said at least one strobe and said audible noise emitted from said audible device are substantially synchronized when said signal received from at least one of said plurality of conductors is a different protocol than an operating protocol of said notification device.

2. The notification device of claim 1 further comprising a plurality of said notification devices connected in parallel with said plurality of conductors.

3. The notification device of claim 1, wherein said controller is further configured to generate a control signal for controlling flashing of said at least one strobe in said strobe system.

4. The notification device of claim 3, wherein said strobe system is further configured to receive said control signal for controlling flashing of said at least one strobe.

5. The notification device of claim 3, wherein said at least one strobe drive circuit is further configured to receive said control signal for controlling flashing of said at least one strobe.

6. The notification device of claim 1, wherein said at least one strobe comprises a first set of at least one LED and a second set of at least one LED, and each of said at least two different colors is determined by a ratio of electrical power supplied to said first set of at least one LED and said second set of at least one LED.

7. The notification device of claim 1, wherein said at least two different colors comprise white and amber.

8. The notification device of claim 1, wherein said received electrical signal comprises a sequence of digital pulses.

9. The notification device of claim 8, wherein said sequence of digital pulses comprises commands to control an audible device.

10. The notification device of claim 8, wherein said controller is configured to determine which one of said at least two different colors is to be illuminated based upon a duration of at least one pulse in said sequence of digital pulses.

11. The notification device of claim 8, wherein said controller is configured to vary an intensity of said strobe system output based upon said sequence of digital pulses.

12. The notification device of claim 1 further comprising a temperature sensor, wherein said controller is configured to vary an intensity of said strobe system output based upon an output from said temperature sensor.

13. The notification device of claim 1, wherein said at least one strobe circuit comprises an energy storage device that stores electrical power, such that said stored electrical power is rapidly discharged to flash said at least one strobe.

14. The notification device of claim 13, wherein said energy storage device is a capacitor.

15. The notification device of claim 1, wherein said at least one strobe comprises an LED having a plurality of LED chips, each of said plurality of LED chips adapted to emit light in a different color.

16. The notification device of claim 1, wherein said at least one strobe comprises at least one Xenon tube.

17. The notification device of claim 16, wherein said strobe device comprises at least one switching device to switch between a plurality of said Xenon tubes.

18. The notification device of claim 17, wherein said switching device is a relay.

19. The notification device of claim 1, wherein at least one of said signal and said electrical power are supplied to said notification device by a master controller.

20. The notification device of claim 19 in communication with a vibration notification device configured to vibrate based upon a signal received from said master controller, such that said master controller signals said vibration notification device to vibrate when said strobe drive circuit flashes said at least one strobe.

21. The notification device of claim 20, wherein said vibration notification device wirelessly communicates with said master controller.

22. The notification device of claim 19, wherein said at least one strobe is flashed by said strobe system when a smoke detector device that is in communication with said master controller detects smoke.

23. The notification device of claim 1 further comprising a synchronization module configured to interrupt said supplied signal from at least one of said plurality of conductors, wherein said synchronization module supplies a signal having a predetermined pulse to said at least one strobe drive circuit and said audible device.

24. A method of visual notification of different types of events by flashing different colors, said method comprising:

receiving a periodic signal in each of a plurality of notification devices;

determining a color and a flash rate in at least one of said plurality of notification devices based upon data contained in said periodic signal; and flashing at least one strobe at said determined color and flash rate in at least one of said plurality of notification devices.

25. The method of claim 24, wherein said plurality of notification devices are connected in parallel.

26. The method of claim 24 further comprising the step of providing said data as to which of said different colors said at least one strobe is flashed, wherein said data is at least one pulse.

27. The method of claim 24 further comprising the step of selecting one of at least two sets of strobes of said at least one strobe.

28. The method of claim 27, wherein each set of said at least two sets of strobes generates light of a different color than any other of said at least two sets of strobes.

29. The method of claim 24, wherein said step of flashing said at least one strobe comprises generating said determined color by changing a ratio of electrical power supplied to each of at least two sets of strobes, each set of strobes emitting light of a different color, so that a combined output of the at least two sets of strobes has the determined color.

30. The method of claim 24 further comprising the step of providing a vibration notification device configured to vibrate when said periodic signal is received by said notification device.

31. The method of claim 24 further comprising the step of emitting an audible noise by said notification device based upon said received periodic signal.

32. The method of claim 31 further comprising the step of synchronizing said audible noise and flashing of said at least one strobe when said received signal is a protocol other than an operating protocol of said notification device.

33. The method of claim 24 further comprising the step of providing said periodic signal in one of a plurality of protocols, wherein said notification device translates a plurality of protocols to a predetermined protocol to determine said color and said flash rate.

34. A notification system comprising:

a master controller;

a notification device in communication with said master controller, wherein said notification device comprises:

at least one strobe drive circuit configured to supply an electrical signal for periodically flashing at least one strobe;

a smoke detector device in communication with said master controller; and an Ethernet connection connecting said master controller and said smoke detector device, wherein an electrical power is supplied to said smoke detector device and a data signal is communicated between said master controller and said smoke detector over said Ethernet connection.

35. The notification system of claim 34, wherein said notification device further comprises a strobe system in communication with said at least one strobe drive circuit, and said strobe system is configured to flash said at least one strobe in one of at least two different colors.

36. The notification system of claim 34, wherein said notification device further comprises a controller in communication with said at least one strobe drive circuit, and said controller is configured to determine which color of at least two different colors to flash said at least one strobe based upon an electrical signal received from said master controller via said Ethernet connection.

37. The notification system of claim 36, wherein said controller receives updates over said Ethernet connection.

38. The notification system of claim 34 further comprising a vibration notification device configured to vibrate based upon a signal received from said master controller, such that said master controller signals said vibration notification device to vibrate when said strobe drive circuit flashes said at least one strobe.

39. The notification system of claim 38, wherein said vibration notification device wirelessly communicates with said master controller.

40. The notification system of claim 34, wherein said notification device further comprises an audible device configured to emit an audible noise based upon said signal received from said master controller.

41. The notification system of claim 40, wherein said flashing of said at least one strobe and said audible noise emitted from said audible device are substantially synchronized when said master controller is operating using a protocol that is different than an operating protocol of said notification device.

42. The notification system of claim 41, wherein said notification device further comprises a synchronization module configured to interrupt said signal supplied from said master controller, wherein said synchronization module supplies a signal having a predetermined pulse to said at least one strobe drive circuit and said audible device.

43. A notification system comprising:

a notification device configured to flash at least one strobe one of at least two different colors based upon a received electrical signal during a time period, said notification device comprising an audible device configured to emit an audible noise;

a vibration notification device remote from said notification device, and is configured to vibrate based upon a received signal, such that said vibration notification device vibrates during said time period said notification device flashes said at least one strobe; and a master controller in communication with said notification device and said vibration notification device, wherein said flashing of said at least one strobe and said audible noise emitted from said audible device are substantially synchronized when said master controller is operating using a different protocol than at least one said notification device.

44. The notification system of claim 43, wherein said notification device further comprises:

at least one strobe device configured to provide an electrical signal for periodically flashing at least one strobe based upon said received signal; and a strobe system in communication with at least one strobe device, and is configured to flash said at least one strobe in one of said at least two different colors.

45. The notification system of claim 43 further comprising a smoke detector device, wherein said master controller commands at least one of said notification device to flash said at least one strobe and said vibration notification device to vibrate when said smoke detector detects smoke.

46. The notification system of claim 43, wherein said vibration notification device is in wireless communication with said master controller.

47. The notification system of claim 43, wherein said notification device further comprises a synchronization module configured to interrupt a power signal communicated from said master controller and to provide an electrical signal having a predetermined pulse to said at least one strobe drive circuit and said audible device.

48. A notification device comprising:

at least one strobe drive circuit configured to provide an electrical signal for periodically flashing at least one strobe based upon a received signal;

a strobe system in communication with said strobe drive circuit, wherein said strobe system is configured to flash at least one strobe in one of at least two different colors; and an audible device configured to emit an audible noise, wherein said flashing of said at least one strobe and said emitting of said audible noise are substantially synchronized when said received signal is a protocol that is different than an operating protocol of at least one said notification device.

49. The notification system of claim 48, wherein said notification device further comprises a synchronization module configured to interrupt said received signal, wherein said synchronization module supplies an electrical signal having a predetermined pulse to said at least one strobe drive circuit and said audible device.

* * * * *

UNITED STATES PATENT AND TRADEMARK OFFICE

CERTIFICATE OF CORRECTION

PATENT NO. : 7,920,053 B2
APPLICATION NO. : 12/188740
DATED : April 5, 2011
INVENTOR(S) : Greg R. Pattok et al.

It is certified that error appears in the above-identified patent and that said Letters Patent is hereby corrected as shown below:

Title Page, Item 75 Inventors, Line 2;

"Michael B. DeWarrd" should be --Michael B. DeWaard--.

Signed and Sealed this
Twelfth Day of July, 2011

David J. Kappos

David J. Kappos
*Director of the United States Patent and Trademark Office*